United States Patent [19]

Edling

[11] 4,285,253

[45] Aug. 25, 1981

[54] MECHANICAL STEEL FOR SHARPENING BLADES

[76] Inventor: Theodore L. Edling, P.O. Box 593, Bethel Island, Calif. 94511

[21] Appl. No.: 114,900

[22] Filed: Jan. 24, 1980

[51] Int. Cl.[3] ..... B21K 11/02; B24B 3/54

[52] U.S. Cl. ..... 76/84; 76/87; 76/89

[58] Field of Search ..... 76/82.2, 83, 84, 85, 76/86, 87, 88, 89; 51/210, 214, 204, 285

[56] References Cited

U.S. PATENT DOCUMENTS

| | | | |
|---|---|---|---|
| 331,545 | 12/1885 | Reinhold | 76/89 |
| 469,615 | 2/1892 | Wardwell, Jr. | 76/89 |
| 813,142 | 2/1906 | Dilg | 51/102 |
| 1,474,636 | 11/1923 | Judd | 76/86 |
| 1,625,219 | 4/1927 | McCall | 76/89 |
| 2,707,852 | 5/1955 | Fillweber | 51/80 BS |
| 2,795,156 | 6/1957 | Murchison | 76/86 |
| 3,526,061 | 9/1970 | Battocchi | 51/102 |
| 4,048,760 | 9/1977 | Gangelhoff | 51/116 |

FOREIGN PATENT DOCUMENTS

| | | | |
|---|---|---|---|
| 14917 | 11/1926 | Netherlands | 76/89 |
| 113591 | 6/1926 | Switzerland | 76/87 |

*Primary Examiner*—Roscoe V. Parker

*Attorney, Agent, or Firm*—Owen, Wickersham & Erickson

[57] ABSTRACT

A fine smooth finish can be obtained on blades without grinding by drawing them against a rotating hardened disk with a smooth peripheral edge. One or a pair of hardened disks having smooth, rounded peripheral edges being disposed adjacent to and partially received by knife-guiding structure, having rotation imparting drive. The use of smooth edged hardened disks enables a very fine finished edge to be obtained, similar to the edge resulting from the use of a hand held steel, and often better.

9 Claims, 14 Drawing Figures

FIG. 1
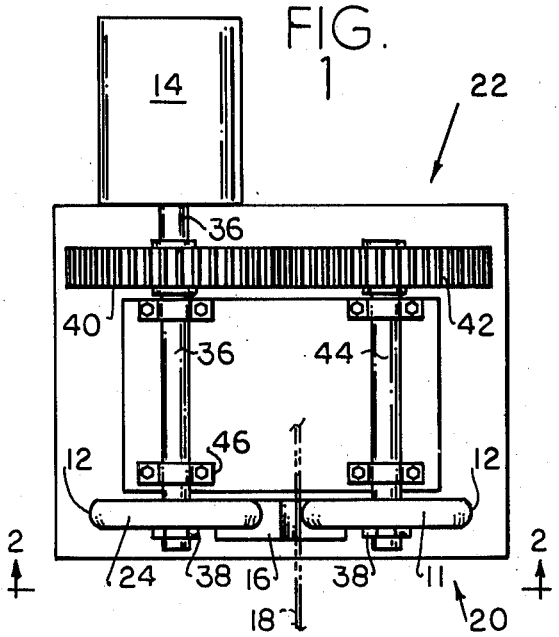
FIG. 2
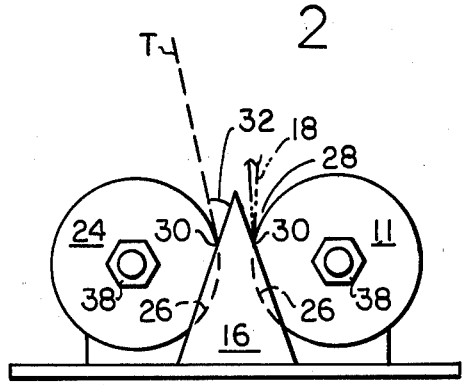
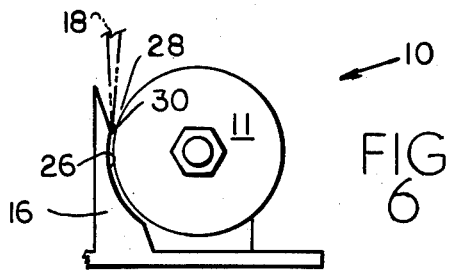
FIG. 6
FIG. 3
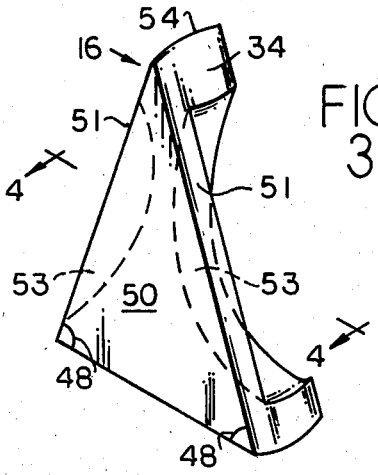
FIG. 4
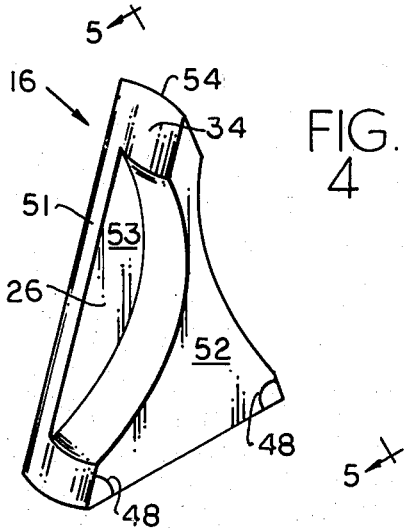
FIG. 5
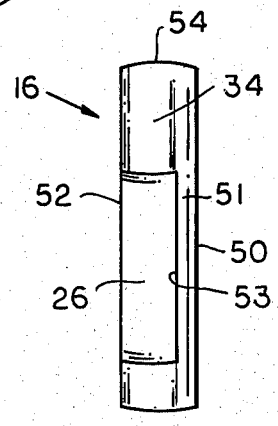

MECHANICAL STEEL FOR SHARPENING BLADES

The invention relates to blade sharpening methods and apparatus, and particularly concerns a mechanical steel for restoring a very fine, sharp, honed edge to knives and the like without grinding their blades.

BACKGROUND OF THE INVENTION

There are two types of finished edge which may be achieved after sharpening a blade, a rough finish and a fine finish. Both rough and fine finishes result in a sharper blade, but a fine finish is preferred. The sharpening methods which result in these two finishes are different, being properly employed under different circumstances.

The grinding method of sharpening is used to achieve the rough finish. It is a desirable method when for example, the blade is chipped, seriously dulled, or when a "belly" or rounding has formed. The grinding method works by removing metal from the blade by abrading against it, thereby exposing a new cutting surface. This method is not desirable when the blade has been only slightly dulled through use, since it is unnecessary to expose a new cutting surface.

The fine finish is achieved by using what is termed a steel. A steel is an elongated tubular piece of hardened metal against which a blade is drawn. The steel works by pushing against the metal of the blade, with the effect of moving back the metal at the edge. Use of a steel does not abrade the blade or wear away at the metal. The angle at which the blade is drawn against the steel and the pressure used in drawing it will be a proportional function of thickness of the blade and dullness of its edge.

The manual sharpening of blades using either method requires a great deal of dexterity. The risk of being cut while attempting to sharpen a knife manually has always been great. To that end, mechanical sharpening devices have been developed for achieving rough finishes, however, no mechanical steel has been invented for achieving fine finishes until the present invention.

The mechanical sharpening devices known in the art work on the grinding principle. Representative is the honing machine of Battocchi (U.S. Pat. No. 3,526,061) wherein two grinding wheels, separated by a blade guide block, rotate in opposite directions; upwardly at their junction with the guide block. The blade to be sharpened is drawn alternatively between one side of the guide block and the grinding wheel and then the other. While Battocchi claims to provide "an exceptionally keen, precision finished cutting edge," that edge would be considered rough finished, according to the terms defined above. Various other configurations, adapted to sharpen both sides of the blade at once, such as the patents to Murchison (U.S. Pat. No. 2,795,156), to Dilg (U.S. Pat. No. 813,142), and to Judd (U.S. Pat. No. 1,474,636); or adapted to sharpening scissors, such as Gangelhoff (U.S. Pat. No. 4,048,760), have been developed, but each involves grinding and results in a rough finish. U.S. Pat. No. 2,707,852 to Fillweber shows a grinding machine where two grind wheels are overlapping. Again, the critical distinction is that this involves grinding. The need for an easy-to-use mechanical device and method for achieving a fine finish has remained unsatisfied until the invention of the present mechanical steel.

OBJECTS OF THE INVENTION

The main object of the invention is to provide an easily used mechanical steel and method for restoring the fine finish, as defined above, to a blade.

Another object of the invention is to provide knife-guiding means which also act as a safety shield to help prevent accidents in using a mechanical steel.

Yet another object of the invention is to provide a mechanical steel having in combination at least one hardened disk with a smooth peripheral edge and a hardened knife-guide partially receiving the disk, wherein the disk is rotated upwardly at its side adjacent to the guide.

Still another object of the invention is to provide a mechanical steel having two partially overlapping hardened disks having smooth peripheral edges, wherein the disks are rotated upwardly where they overlap.

These together with other objects and advantages which will become subsequently apparent, are all admirably satisfied in the present invention.

SUMMARY OF THE INVENTION

The mechanical steel of the present invention includes in combination a hardened disk, drive means for rotating the disk, and hardened knife-guiding means adjacent to the disk on the side of its upward rotation.

The present invention also teaches a method of sharpening blades, by drawing the blade against the smooth rounded edge of a rotating hardened disk, the direction of rotation being upward at the point of contact with the blade.

Further teachings include the employ of two hardened disks separated by and partially received by a hardened knife-guiding means, with drive means to rotate the disks in opposite directions so that their direction of rotation is upward at the point where they are received by the knife-guiding means.

Another embodiment includes two partially overlapping hardened disks and means to rotate them upwardly at the point where they overlap.

Other and further modifications will be apparent from the following detailed description of the invention with reference to the figures.

BRIEF DESCRIPTION OF THE DRAWINGS

FIG. 1 is a top plan view of a blade sharpener or mechanical steel embodying the principles of the invention;

FIG. 2 is a front end view of the device of FIG. 1 taken along the line 2—2 on FIG. 1, with the drive means not shown;

FIG. 3 is a perspective view of the knife-guiding means from the front and left;

FIG. 4 is a perspective view of the knife-guiding means viewed along line 4—4 in FIG. 3;

FIG. 5 is a side view of the knife-guiding means viewed along the line 5—5 in FIG. 4;

FIG. 6 is a front end view of a single-disk blade sharpener or mechanical steel embodying the principles of the invention, showing an alternative embodiment of the knife guiding means and not showing rotation imparting means;

FIG. 8A is an expanded view of a portion of the edge of a blade having been sharpened by grinding to a rough finish;

FIG. 8B is an expanded view of a portion of the edge of a blade having been sharpened with the invention to a fine finish;

FIG. 9A is a front view in section showing blade after sharpening using the invention;

FIG. 10A is a top plan view of the blade sharpener shown in FIG. 10 along the line 10—10, not showing the drive means.

DESCRIPTION OF THE PREFERRED EMBODIMENTS

Figure 10:
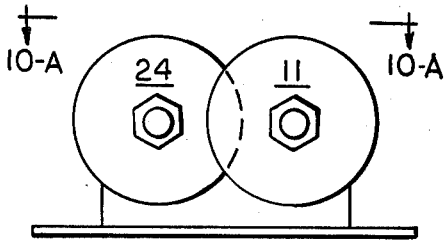
FIG. 10 is a front end view of a blade sharpener or mechanical steel embodying the principles of the invention, where the two disks overlap and the drive means are not shown.

The simplest embodiment of the mechanical steel 10 of the invention requires only a hardened disk 11, substantially equal to or harder than the hardness of the blade being sharpened, with a smooth peripheral edge 12, along with drive means 14 to rotate the disk 11. A blade to be sharpened is carefully drawn against the edge 12 of the rotating disk 11, which pushes upward against the blade's metal, thereby sharpening the blade to a smooth fine finish. A preferred form of this embodiment requires that the peripheral edge 12 be both smooth and rounded.

Keeping the blade at the proper point of contact would be difficult when only the elements so far mentioned are used, but this difficulty may be overcome by providing hardened knife-guiding means 16 adjacent to the disk 11. Both the means 16 and the disk 11 must be substantially as hard or harder than the blade to be sharpened. This simple single-wheel embodiment of the invention is illustrated in FIG. 6, where the knife-guiding means 16 are shown partially receiving the disk 11. In this embodiment, the recess 26 for receiving the disk 11 is shown extending entirely through the knife-guiding means 16. A blade 18 is shown in position to be sharpened. While any direction of drawing the blade 18 will suffice, the preferred direction for drawing the blade 18 is from hilt to point. (Indicated by arrow A in FIG. 8). In the single-disk embodiment so far described, the two sides of the blade 18 would be sharpened by first drawing it (hilt to point) towards the front 20 of the device and then drawing it (hilt to point) towards the rear 22 of the mechanical steel 10, thereby exposing both sides of the blade 18 to the sharpening action of the hardened disk 11.

As shown in FIG. 2, a preferred embodiment of the invention includes a pair of disks 11 and 24 and a center post 16, which in a further preferred embodiment is of triangular shape described in more detail later. The disks 11 and 24 are made to rotate so that the direction of their rotation is upward where they come closer to the center post or knife-guiding means 16. As seen from the front, the disk 11 therefore rotates in a clockwise direction and the disk 24 rotates in a counter-clockwise direction.

The relationship of the disks 11 and 24 to the center post 16 is important to the invention. The center post or knife-guiding means 16 has recess means 26 to receive a portion of each disk 11 and 24. The disks 11 and 24 and the knife guiding means 16 cooperate to provide knife receiving spaces 28 with vertices 30 where a point on the periphery 12 of each rotating disk leaves the recess 26. This relationship between the disks 11 and 24 and the knife guiding means 16 also has another important function; it is responsible for determining an angle 32 between an edge 34 of the knife-guiding means 16 and a tangent T taken to a disk 11 or 24 at point 30 (see FIG. 2). This angle 32 may be between 30 degrees and 50 degrees to enable the desired range of sharpening angles to suit a variety of particular needs. It is, however, preferred that the angle 32 be substantially 40 degrees. Preferably, the edges 34 are rounded, as illustrated.

FIG. 10 shows an embodiment in which two hardened disks 11 and 24 are disposed so that they are partially overlapping. The disks should have a smooth peripheral edge. Drive means are used to overlap the disks upwardly at the area where they overlap.

Any suitable drive means may be used for imparting rotation to the disks 11 and 24, as generally represented by numeral 14 on FIG. 1. The rotation-imparting means 14 may be an electric motor connected by shaft or capstain to the disk, a hand crank or the like. It is desirable that the rotation-imparting means be capable of variable speeds, whether those speeds be at fixed intervals such as high, medium, and low, or be continuously variable. It has been found that the speed at which the disks rotate will be proportional to the sharpening rate. Variability is desirable to accommodate blades having different needs for sharpening.

FIG. 1 shows a top plan view of one embodiment of the invention wherein the rotation-imparting means 14 is connected via a shaft 36 to the disk 24 which is mounted on the shaft 36 and held in place by securing means 38 which, for example, may be a nut and washer. Also mounted on the shaft 36 is a gear 40 meshing with a gear 42 which is similarly mounted on a shaft 44. The shaft 44 is connected to the disk 11.

In this manner, rotation by the drive means 14, of the shaft 36 will cause the disk 24 to rotate and through the gears 40 and 42 will cause the disk 11 to rotate in the opposite direction. Also shown in FIG. 1 are journal bearings 46 which support shafts 36 and 44.

It is preferred that the disks 11 and 24 have rounded peripheral edges 12 which, in conjunction with the rounded sides 34 of the knife-guiding means 16 (as shown in FIGS. 3 and 4) enable the blade 18 being sharpened to be drawn through the knife receiving spaces 28 at a variety of angles instead of only at right angles to the disks 11 and 24, as would be required if no rounding was used. This feature adds to the ease with which the invention may be used.

Figure 7:
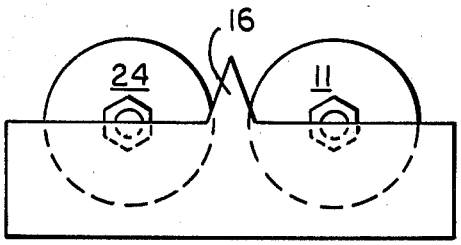
FIG. 7 is a front end view of a blade sharpener or mechanical steel showing knife-guiding means extended to serve as a complete front safety guard.
Figure 7:
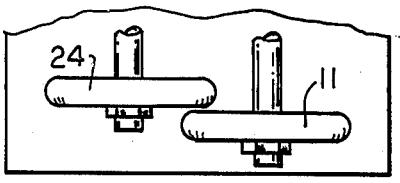

FIGS. 3, 4 and 5 show a preferred form of the knife-guiding means 16, which is in a triangular shape. The ratio of height to base of the triangle is important, for it relates to the desired angle 32 of intersection with the disks 11 and 24 to yield optimal sharpening results. As shown and preferred, the base angles 48 of the triangular knife-guiding means 16 are equal. It may be seen that the preferred front 50 of the knife guiding means 16 is uncut, with linear edges 51 presenting a guard 53 covering the recesses 26 for preventing accidental insertion of fingers or clothing. In fact, the guard 53 could be extended to cover the entire bottom half of the mechanical steel's front. (Indicated in FIG. 7). The knife-guiding means has a back 52 provided with the recess means 26 having an arc corresponding to a circle with a radius slightly greater than the radius of the disks 11 and 24, so that there is no physical point of contact between the knife-guiding means 16 and the disks 11 and 24. The recesses 26 are designed to receive only a portion of the disks at a location oriented to yield the desired angle 32 and point of contact 30.

The preferred depth of the knife-guiding means 16 is therefore greater than the depth of a disk 11 or 24, so that when the recess means 26 are formed in the back 52, a shield or guard 53 remains at the front 50. Of course, the invention will still function if the recess means 26 extend completely through the knife guiding means 16. As shown, the top corner 54 of the knife guiding means 16 is rounded, as are the sides 34.

It is critical to practicing the invention that the disks 11 and 24 and the knife-guiding means 16 be made of a hardened material having a hardness substantially equal to or greater than the knives to be sharpened. Of course, increased hardness is preferred. A suggested material is high carbon steel, hardened to a hardness at least equal to Rockwell 48. In a preferred embodiment, high carbon steel of a hardness equal to Rockwell 65 is used. Rockwell 65 indicates tempering a starting material of 4340 normally hardened steel for eight hours in an oven at 1500° F., and then dipping the tempered steel in oil. Another starting material could be 8260 case hardening steel, which is then tempered. Other hard materials may be used in the practice of the invention. The critical feature is the degree of hardness of the components; not the actual material they are made of. Therefore, alloys, other metals, glass, hardened ceramics, crystal, or even a diamond disk could be used instead of steel, provided the hardness is sufficient.

This hardness is required to prevent the knife from cutting into the sharpener, and also to enable the harder wheels to push against the metal of the blade. The action of a rotating harder disk 11 or 24 pushing against and moving metal of the blade 18, causes the blade 18 to be reshaped and its edge to be straightened and aligned without grinding away the metal of the blade.

Figure 8:
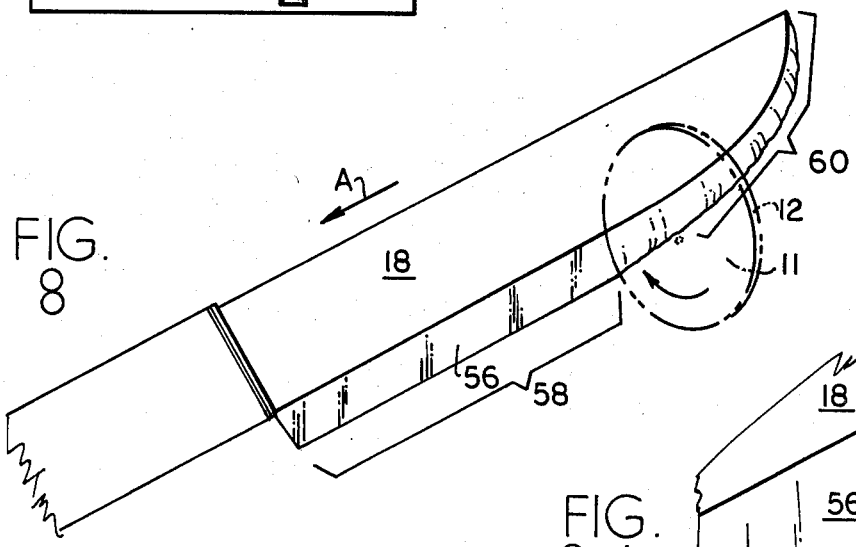
FIG. 8 is a side view of a knife being sharpened by a hardened disk, showing the edge before and after sharpening.
Figure 8:
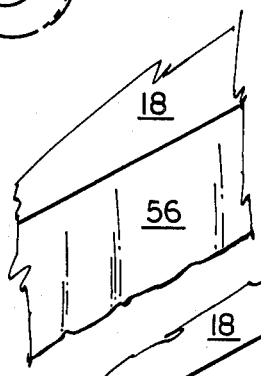
Figure 8:
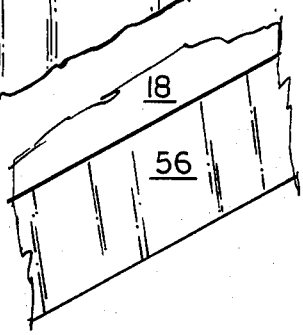

As shown in FIG. 8, a blade 18 will be drawn against the edge 12 of a rotating hardened disk 11 so that the metal at its edge 56 will be pushed, thereby being straightened, aligned, and sharpened to a fine finish. As illustrated in FIG. 8, the knife blade 18 being drawn in the direction indicated by arrow A is straight and sharp in the area 58 which has contacted the disk 11, but is rounded blunt and out of alignment in the area 60 which has not yet contacted the disk.

Figure 9:
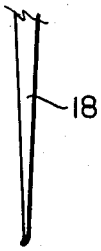
FIG. 9 is a front view in section showing a dulled blade before sharpening.
Figure 9:
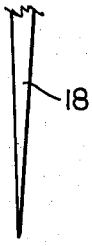

This method of pushing against the metal of the blade is responsible for the superior results of the invention and is the reason why the results from this type of sharpener are comparable to the use of a manual steel for producing a smooth fine-finished sharpened blade. FIG. 8A shows the result of sharpening by grinding which is a rough finish. FIG. 8B shows the result of sharpening by using a steel, whether manual or mechanical, which is a fine finish. A view in section of a blade 18 which is dull is shown in FIG. 9, and the sharpened resulting blade 18 is shown in FIG. 9A. To that effect, the rounding at the smooth peripheral edge 12 of the disks is preferably made substantially the same as the rounding of a hand held steel.

The method of mechanically sharpening blades to a smooth finished edge, according to the present invention, includes drawing the blade against the smooth, rounded peripheral edge of a rotating hardened disk at a point where the direction of rotation is upward, thereby aligning and sharpening the blade to a fine finish.

To those skilled in the art to which this invention relates, many changes in construction and widely differing embodiments and applications of the invention will suggest themselves without departing from the spirit and scope of the invention. The disclosure and the description herein are purely illustrative and are not intended to be in any way limiting.

I claim:

1. A mechanical steel comprising:

a hardened disk of a hardness substantially equal to or greater than the hardness of knives to be sharpened, said disk having a smooth transversely rounded peripheral edge, drive means for rotating said disk about its axis, and sloped knife-guiding means disposed to partially receive said disk, the slope of said knife-guiding means forming an angle of substantially 40 degrees with a tangent to the disk at the point where its rotation exits the area where the disk is received in the knife-guiding means.

2. A mechanical steel for sharpening blades which comprises:

a pair of coplanar hardened disks each having a smooth transversely rounded peripheral edge, drive means for rotating said disks in directions opposite to each other, so that the direction of rotation of each disk is upward at the points where they are nearest to each other, and hardened knife-guiding means disposed between and separating said disks.

3. The mechanical steel for sharpening blades as described in claim 2 wherein said hardened knife-guiding means has a pair of recesses so that one recess accommodates a portion of each of said disks, said disks being partially disposed within but out of physical contact with said recesses.

4. The mechanical steel for sharpening blades as claimed in claim 3 wherein said hardened knife-guiding means comprises a triangular post having a greater thickness than said disks, said post with a front and a rear face, and having equal angles at its base, and wherein said recess means comprise a semicircular cavity extending into the rear face of said triangular post but not completely through it, so that the front face acts as a protecting guard for the user.

5. The mechanical steel for sharpening blades as described in claim 3 wherein the angle between the side of said knife-guiding means and a tangent taken to the edge of each said disk at the point where its rotation exits said recess is between 30 and 50 degrees.

6. The mechanical steel for sharpening blades as described in claim 5 wherein said angle is substantially 40 degrees.

7. The mechanical steel for sharpening blades as described in claim 2 wherein said disks and said knife-guiding means are made of hardened steel.

8. The mechanical steel for sharpening blades as described in claim 2 wherein said hardened disks and knife-guiding means are at least of a hardness equal to Rockwell 48.

9. The mechanical steel for sharpening blades as described in claim 2 wherein said hardened disks and knife-guiding means are at least of a hardness equal to Rockwell 65.

* * * * *